US009509072B2

(12) United States Patent
Endo et al.

(10) Patent No.: US 9,509,072 B2
(45) Date of Patent: Nov. 29, 2016

(54) PRESS-FIT CONNECTOR TERMINAL

(71) Applicant: DAI-ICHI SEIKO CO., LTD., Kyoto (JP)

(72) Inventors: Takayoshi Endo, Shizuoka (JP); Sakai Yagi, Shizuoka (JP); Takuya Takeda, Shizuoka (JP)

(73) Assignee: DAI-ICHI SEIKO CO., LTD. (JP)

( * ) Notice: Subject to any disclaimer, the term of this patent is extended or adjusted under 35 U.S.C. 154(b) by 0 days.

(21) Appl. No.: 14/955,772

(22) Filed: Dec. 1, 2015

(65) Prior Publication Data

US 2016/0164201 A1 Jun. 9, 2016

(30) Foreign Application Priority Data

Dec. 3, 2014 (JP) ..... 2014-245219

(51) Int. Cl.
*H01R 13/42* (2006.01)
*H01R 12/00* (2006.01)
*H01R 12/58* (2011.01)

(52) U.S. Cl.
CPC ..... *H01R 12/585* (2013.01)

(58) Field of Classification Search
CPC .... H01R 12/585; H01R 9/091; H01R 12/05; H01R 12/58; H01R 43/205; H01R 43/20; H01R 13/111; H01R 12/523; H01R 12/7064; H01R 13/04
USPC ..... 439/82, 751
See application file for complete search history.

(56) References Cited

U.S. PATENT DOCUMENTS 5,083,927 A * 1/1992 Herard ..... H01R 9/091 439/80
8,888,541 B2 * 11/2014 Endo ..... H01R 12/585 439/751
8,968,010 B2 * 3/2015 Endo ..... H01R 4/48 439/82
9,240,646 B2 * 1/2016 Endo ..... H01R 12/585
9,300,059 B2 * 3/2016 Endo ..... H01R 4/48

FOREIGN PATENT DOCUMENTS

JP 2009021016 1/2009 ..... H01R 12/04

* cited by examiner

*Primary Examiner* — Xuong Chung Trans
(74) *Attorney, Agent, or Firm* — Hayes Soloway P.C.

(57) ABSTRACT

A press-fit connector terminal includes: a terminal body having a length sufficient to pass through an electrically conductive through-hole formed through a circuit substrate; and a contact unit arranged around the terminal body so as to surround therewith about a central axis of the terminal body, the contact unit being formed capable of expanding/contracting in a radial direction around the central axis. The contact unit has rigidity lower than that of the terminal body, the terminal body is made of material with electrical conductivity greater than that of the contact unit; and when the terminal body and the contact unit are integrally inserted into the through-hole, a gap exists between the terminal body and the contact unit so that the contact unit is movable relative to the terminal body in the radial direction within the through-hole.

14 Claims, 21 Drawing Sheets

PRESS-FIT CONNECTOR TERMINAL

BACKGROUND OF THE INVENTION

Field of the Invention

The present invention relates to a press-fit connector terminal to be inserted into an electrically conductive through-hole formed through a circuit substrate, and more particularly to a press-fit connector terminal through which a large amount of current can pass.

Description of the Related Art

In these days, there is an increasing demand for a press-fit connector terminal through which a current in the range of about 60 to 80 A/pin can run. In order for a press-fit connector terminal to make it possible to allow a much current to run there-through, the press-fit connector terminal is necessary to have a large cross-section. That is, a press-fit connector terminal is necessary to be made of an electrically conductive sheet having an increased thickness. However, a press-fit connector terminal made of a sheet having an increased thickness is accompanied with a problem that since spring performance of a press-fit connector terminal is deteriorated, and hence, the press-fit connector terminal cannot avoid being solid, resulting in that when the press-fit connector terminal is inserted into a through-hole formed through a circuit substrate, it is afraid that the press-fit connector terminal may damage an inner surface of the through-hole and/or a circuit substrate.

For instance, Japanese Patent Application Laid-open on No. 2009-21016 discloses a press-fit terminal. A press-fit terminal having a relatively large thickness is illustrated in FIGS. 4 and 5 thereof. It is considered that when the press-fit terminal is inserted into a through-hole, elastic contact pieces defining the press-fit terminal contact with an inner surface of the through-hole, and act as a spring to the through-hole.

Furthermore, since an inner surface of the through-hole has a broad area where contact pressure is received from the elastic contact pieces, it is considered that it is possible to prevent the through-hole and a resin-embedded portion of the circuit substrate from being creep-deformed due to an elastic reaction force caused by the elastic contact pieces.

As mentioned above, if a press-fit connector terminal is designed to have an increased thickness in order to allow a large amount of current to run there-through, the press-fit connector terminal will be accompanied with a problem that since the spring performance thereof is deteriorated, and hence, the press-fit connector terminal cannot avoid from being solid, resulting in that when the press-fit connector terminal is inserted into a through-hole formed through a circuit substrate, it is afraid that the press-fit connector terminal may damage an inner surface of the through-hole and/or a circuit substrate.

Since the press-fit terminal suggested in FIGS. 4 and 6 of the above-identified Publication does not have a floating structure, when the press-fit terminal is inserted into a through-hole, there occurs fluctuation in contact pressure exerted by the elastic contact pieces onto an inner surface of a through-hole, resulting in deterioration in stability in connection therebetween.

SUMMARY OF THE INVENTION

In view of the above-mentioned problems in the conventional press-fit connector terminals, an object of the present invention is to provide a press-fit connector terminal capable of allowing a relatively large amount of current to run there-through, not damaging a circuit substrate, and providing excellent stability in connection between itself and a through-hole.

A first aspect of the present invention provides a press-fit connector terminal, comprising: a terminal body having a length sufficient to pass through an electrically conductive through-hole formed through a circuit substrate; and a contact unit arranged around the terminal body so as to surround therewith about a central axis of the terminal body, the contact unit being formed capable of expanding/contracting in a radial direction around the central axis, wherein: the contact unit has rigidity lower than that of the terminal body; the terminal body is made of material with electrical conductivity greater than that of the contact unit; and when the terminal body and the contact unit are integrally inserted into the through-hole, a gap exists between the terminal body and the contact unit so that the contact unit is movable relative to the terminal body in the radial direction within the through-hole.

According to the above structure, the contact unit can have a function as acting as a press-fit terminal, ensuring that when the press-fit connector terminal is inserted into the through-hole of the circuit substrate, the press-fit connector terminal does not damage the circuit substrate and/or an inner surface of the through-hole, and further ensuring stable connection between the press-fit connector terminal and the through-hole.

In addition, the contact unit is movable relative to the terminal body within the through-hole. Thus, the contact unit and the terminal body can have a floating structure. This ensures that when the press-fit connector terminal is fit into the through-hole of the circuit substrate, even if the press-fit connector terminal and the through-hole axially deviate from each other, the floating structure absorbs the axial deviation to thereby equalize contact pressure between the contact unit and the inner surface of the through-hole, ensuring stable connection between the press-fit connector terminal and the through-hole.

A second aspect of the present invention provides, in addition to the first aspect, wherein the contact unit includes a plurality of contact pieces arranged around the terminal body to outwardly protrude.

A third aspect of the present invention provides, in addition to the first aspect, further comprising first and second binders surrounding the terminal body at distal and proximal ends of the contact unit, wherein: each of the first and second binders has a C-shaped cross-section; and the contact pieces are connected to the first and second binders.

A fourth aspect of the present invention provides, in addition to the third aspect, further comprising a cover situated adjacent to the first binder, wherein the cover covers a distal end of the terminal body.

A fifth aspect of the present invention provides, in addition to the fourth aspect, wherein the cover includes: a flat portion; and a plurality of extensions extending in a common direction from an outer periphery of the flat portion; one of the extensions is connected to the contact unit through the first binder; and the terminal body is bonded at a top surface thereof with a lower surface of the flat portion such that the contact unit is swingable relative to the terminal body around the top surface of the terminal body.

A sixth aspect of the present invention provides, in addition to the third aspect, further comprising: a support portion made of an electrically conductive material; and a connecting portion, wherein: the terminal body stands on an upper surface of the support portion; the connecting portion extends towards the support portion from the second binder;

and the connecting portion is bonded to a side of the support portion such that there is a gap generated between the second binder and an upper surface of the support portion.

A seventh aspect of the present invention provides, in addition to the sixth aspect, wherein: an elastically deformable boundary portion is formed between the second binder and the connecting portion; and the boundary portion is positioned on a level with the gap.

An eighth aspect of the present invention provides, in addition to the sixth aspect, wherein the support portion is constituted of two electrically conductive sheets bonded to each other at an end thereof and overlapping one on another.

A ninth aspect of the present invention provides, in addition to the sixth aspect, wherein the terminal body and the support portion are made of a material having electrical conductivity of at least 99.9% IACS.

The advantages obtained by the aforementioned present invention will be described hereinbelow.

The press-fit connector terminal according to the present invention is able to allow a relatively large amount of current to run there-through, exert no damages to a circuit substrate, and provide stable connection between itself and a circuit substrate.

DESCRIPTION OF THE PREFERRED EMBODIMENTS

First Embodiment

Figure 1:
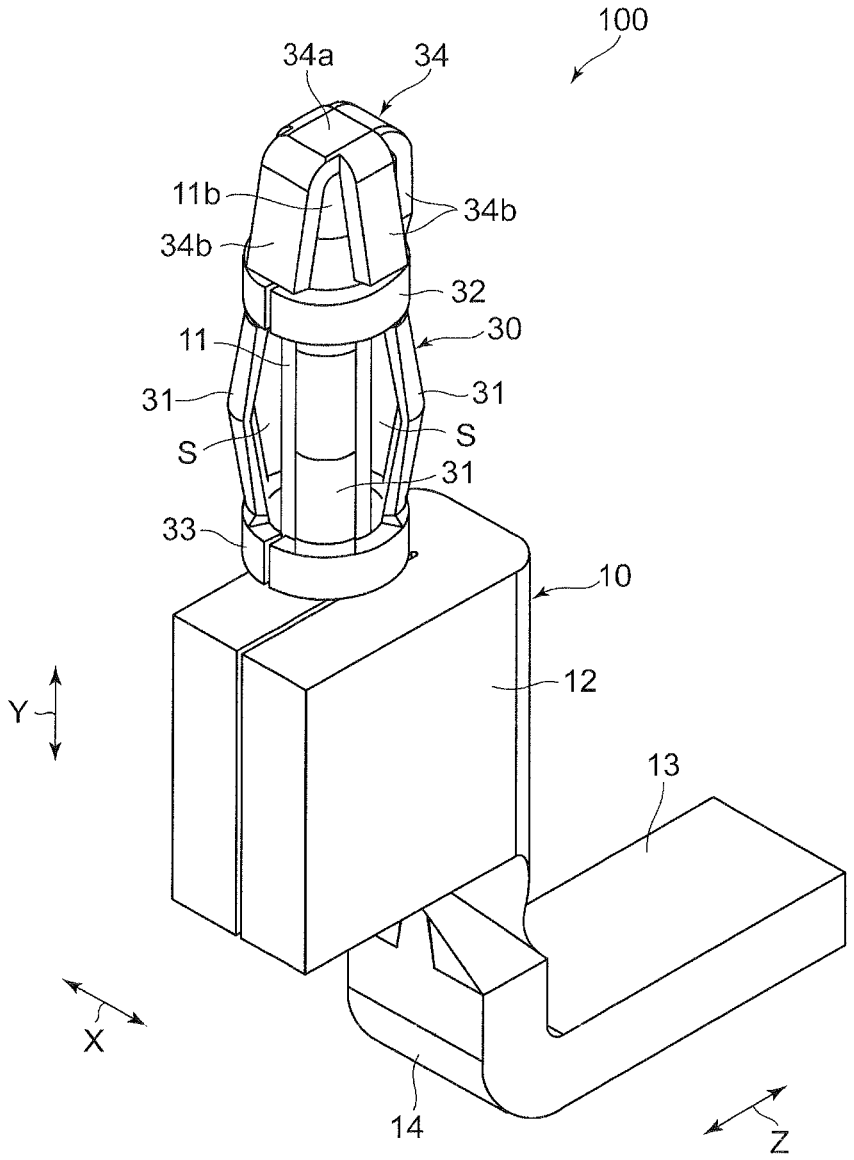
FIG. 1 is a perspective view of the press-fit connector terminal according to the first embodiment of the present invention.

A press-fit connector terminal 100 according to the first embodiment of the present invention is explained hereinbelow with reference to FIGS. 1 to 16. In the specification, a direction indicated with an arrow X illustrated in FIG. 1 indicates a left-right or a horizontal direction, a direction indicated with an arrow Y illustrated in FIG. 1 indicates an up-down or a vertical direction, and a direction indicated with an arrow Z illustrated in FIG. 1 indicates a front-rear direction.

As illustrated in FIGS. 1 to 3 and 10, the press-fit connector terminal 100 according to the first embodiment of the present invention includes a pin section 10, a terminal body 11, a contact unit 30, and a cover 34.

The pin section 10 is fabricated by steps of punching a metal sheet having electrical conductivity into a predetermined shape, and pressing the punched metal sheet, including collapsing and bending steps. The pin section 10 includes a support portion 12 comprised of a metal sheet folded into a U-shape, an elbow portion 14 continuous to a lower surface of the support portion 12, and a flat connection portion 13 backwardly extending from the elbow portion 14. A bonding wire (not illustrated) is connected at an end thereof to the flat connection portion 13.

Figure 4:
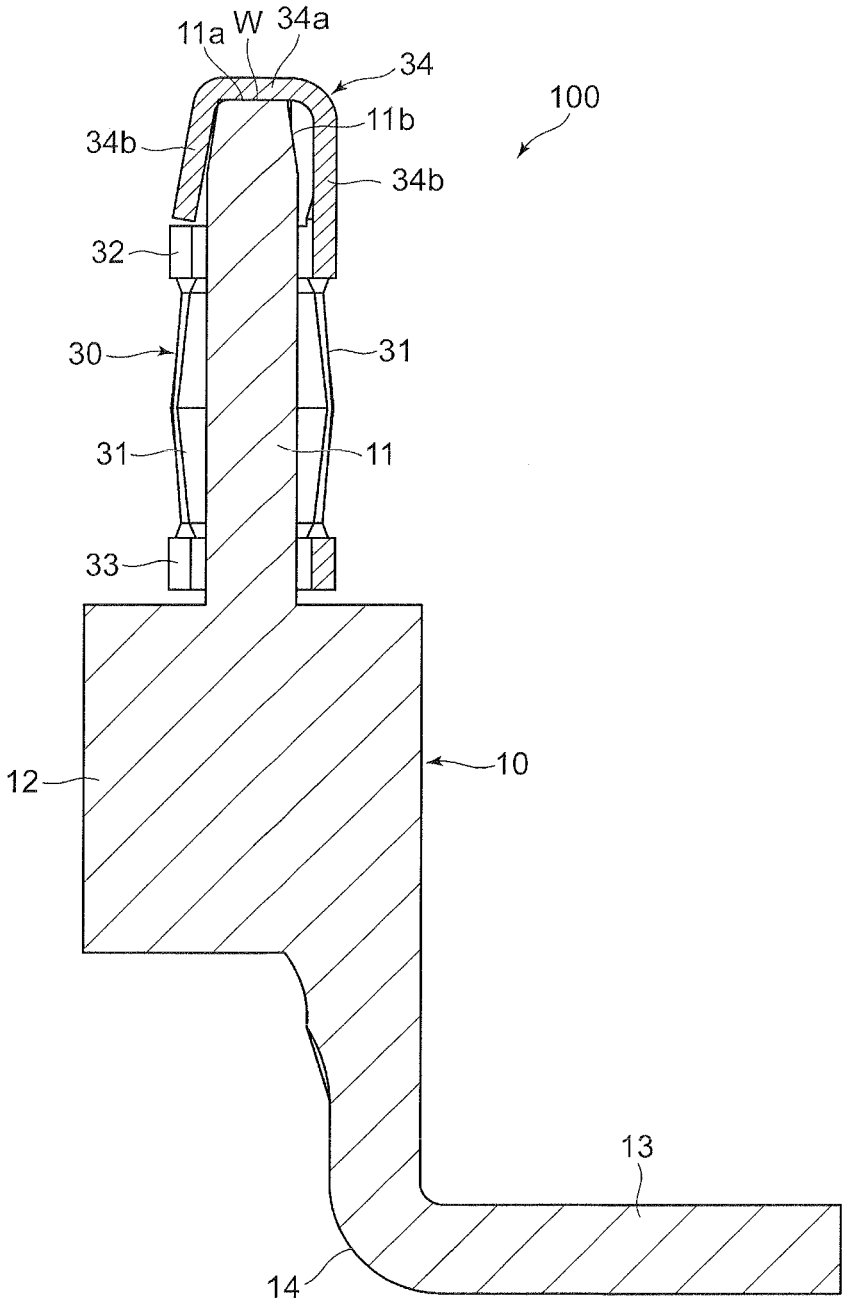
FIG. 4 is a cross-sectional view taken along the line A-A shown in FIG. 3.
Figure 5:
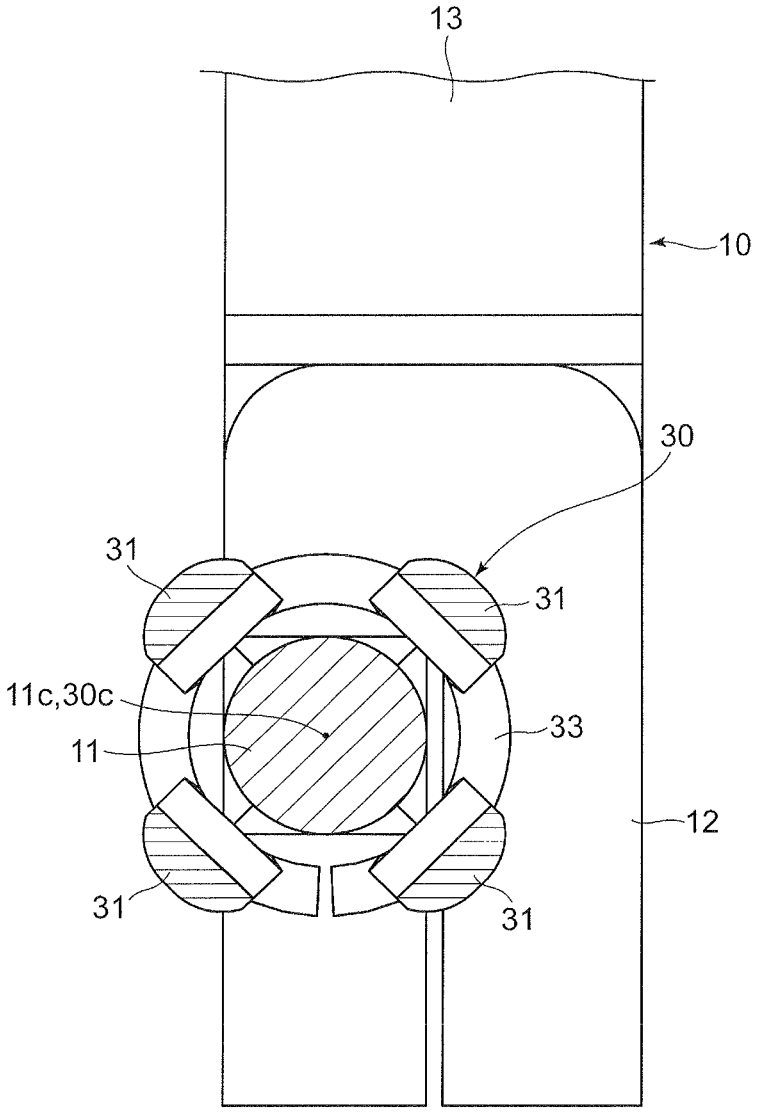
FIG. 5 is a cross-sectional view taken along the line B-B shown in FIG. 3.
Figure 6:
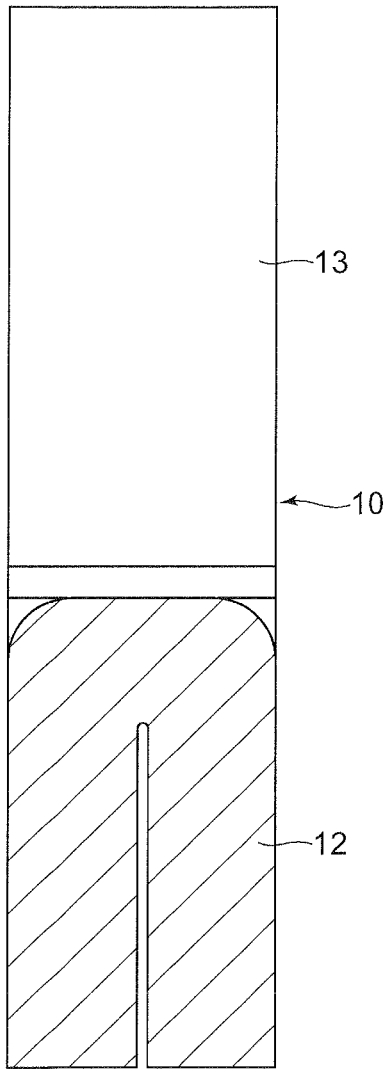
FIG. 6 is a cross-sectional view taken along the line C-C shown in FIG. 3.

The terminal body 11 stands on an upper surface of the support portion 12. As illustrated in FIG. 4, the terminal body 11 includes a cylindrical portion and an upper portion 11*b* formed continuous to the cylindrical portion and having a shape of a truncated cone.

The terminal body 11 is designed to have a length sufficient to pass through an electrically conductive through-hole 301 (see FIG. 10) formed through a circuit substrate 300.

The contact unit 30 is arranged around the terminal body. The contact unit 30 is able to elastically contact with an inner surface 302 (see FIG. 10) of the through-hole 301.

The contact unit 30 and the pin section 10 are made of a material having electrical conductivity and acting as a spring to a greater degree than the terminal body 11.

The pin section 10 and the terminal body 11 are made of a material having a higher electrical conductivity than the same of the contact unit 30.

The pin section 10 and the terminal body 11 can be made of any material. For instance, the pin section 10 and the terminal body 11 are made preferably of copper, particularly pure copper, having electrical conductivity of 99.9% IACS or greater.

The terminal body 11 and the contact unit 30 are designed to have such a size that when the press-fit connector terminal 100 is fit into the through-hole 301, between the terminal body 11 and the contact unit 30 is generated a gap S sufficient for the contact unit 30 to be able to come close to and go away from the said terminal body 11.

The contact unit 30 is connected to the terminal body 11 such that when the press-fit connector terminal 100 is fit into the through-hole 301, the contact unit 30 is movable relative to the terminal body 11, as later explained in detail.

The contact unit 30 is fabricated by bending a single metal sheet having elasticity. The contact unit 30 is comprised of a plurality of contact pieces 31 arranged around the terminal body 11 or an imaginary center line 30*c* of the contact unit 30. Each of the contact pieces 31 is bent by an obtuse angle or outwardly protrudes at a center thereof in a length-wise direction thereof. Each of the contact pieces 31 is elastically deformable, specifically elastically expandable and shrinkable, relative to the terminal body 11 or the imaginary center line 30*c*.

The press-fit connector terminal 100 further includes first and second C-shaped binders 32 and 33 surrounding the terminal body at distal (upper) and proximal (lower) ends of the contact unit 30. The contact pieces 31 are connected at upper and lower ends thereof to the first and second binders 32 and 33.

The cover 34 is situated above the first binder 32 to cover the upper portion 11*b* of the terminal body 11 therewith.

As illustrated in FIGS. 1 to 4, the cover 34 includes a flat portion 34*a* extending in parallel with a flat top surface 11*a* of the upper portion 11*b* of the terminal body 11, and a plurality of extensions 34*b* downwardly extending from an outer periphery of the flat portion 34*a* towards the first binder 32 such that the extensions 34*b* surround the upper portion 11*b* of the terminal body 11. The extensions 34*b* spread like a skirt and are equally spaced away from one another. One of the extensions 34*b* is connected to the first binder 32.

Figure 2:
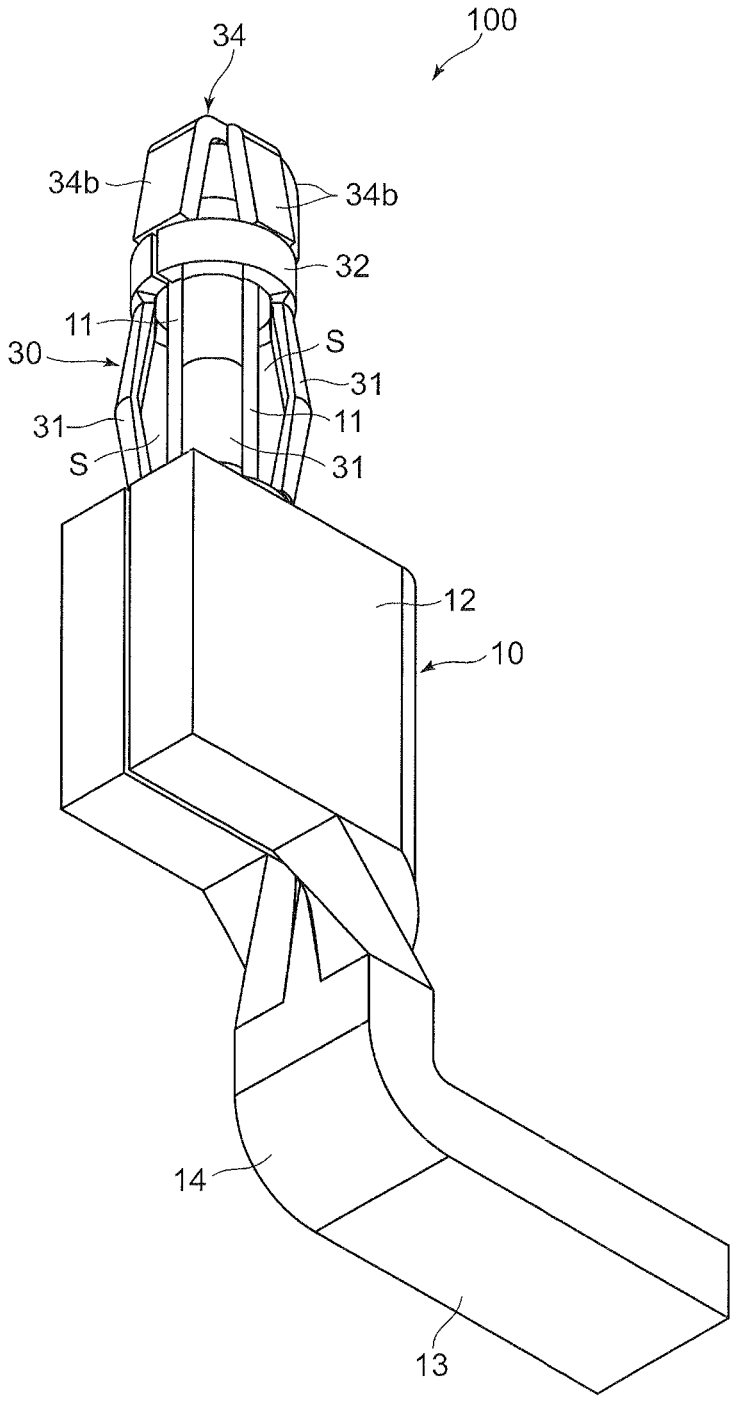
FIG. 2 is a perspective view of the press-fit connector terminal illustrated in FIG. 1.
Figure 3:
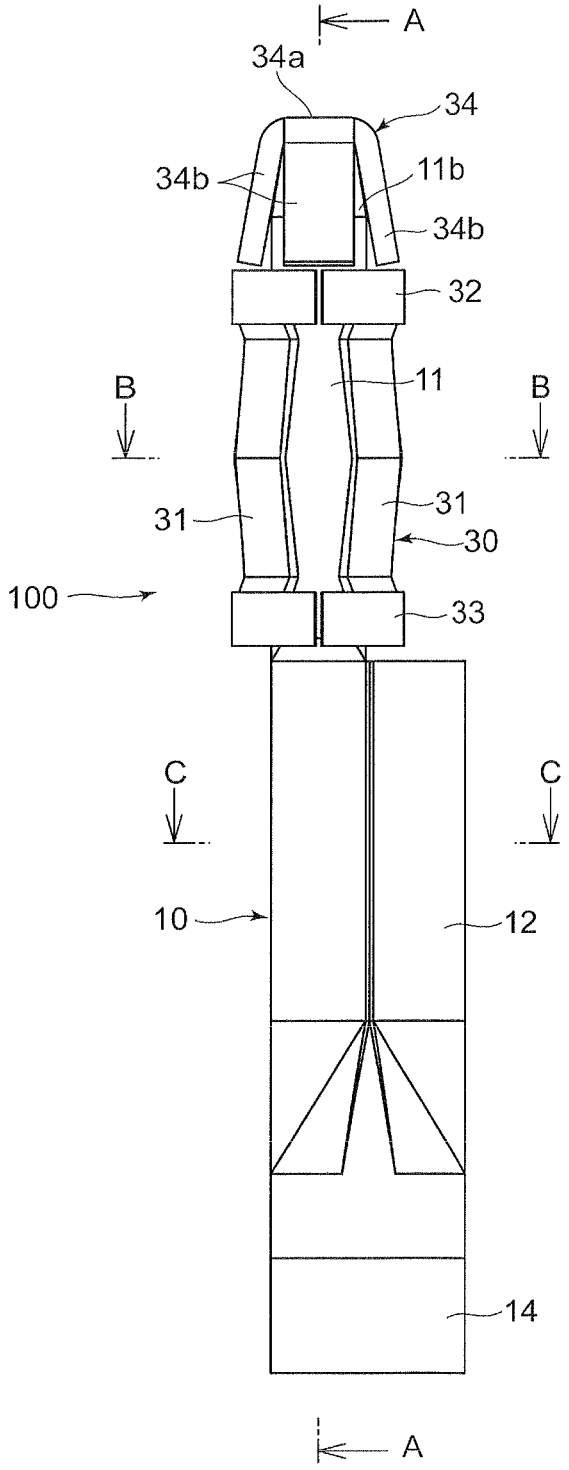
FIG. 3 is a front view of the press-fit connector terminal illustrated in FIG. 1.
Figure 7:
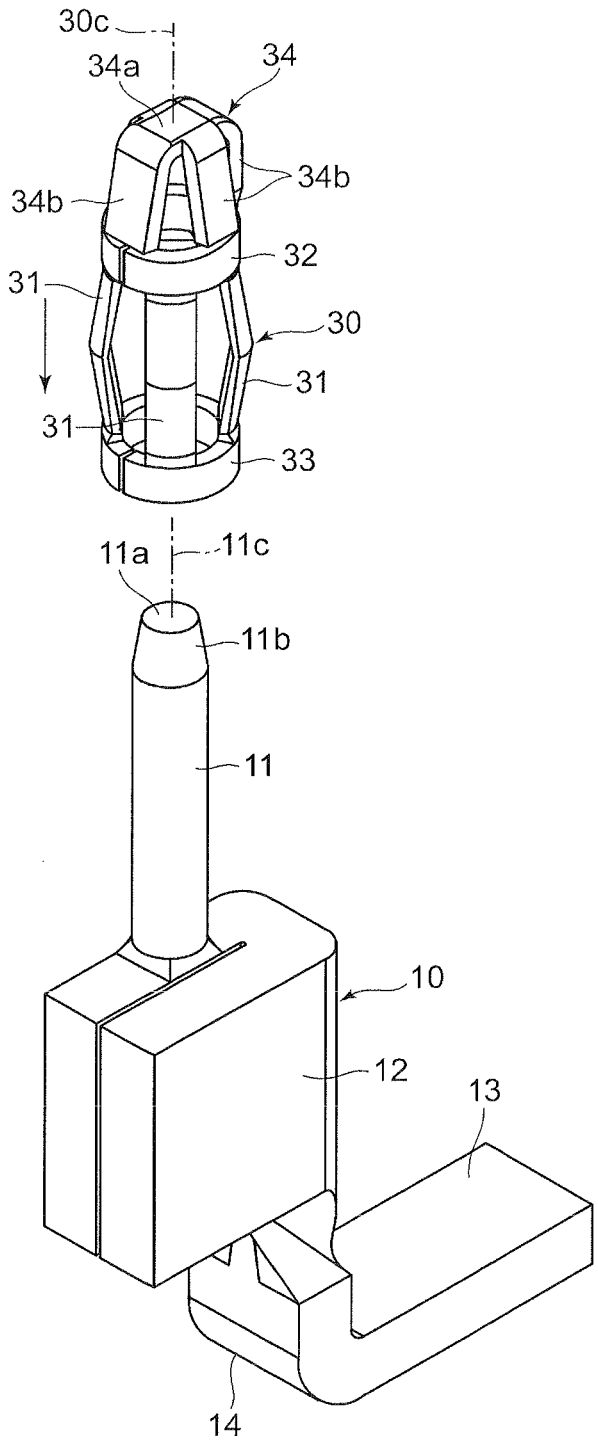
FIG. 7 is a broken perspective view of the press-fit connector terminal illustrated in FIG. 1.
Figure 8:
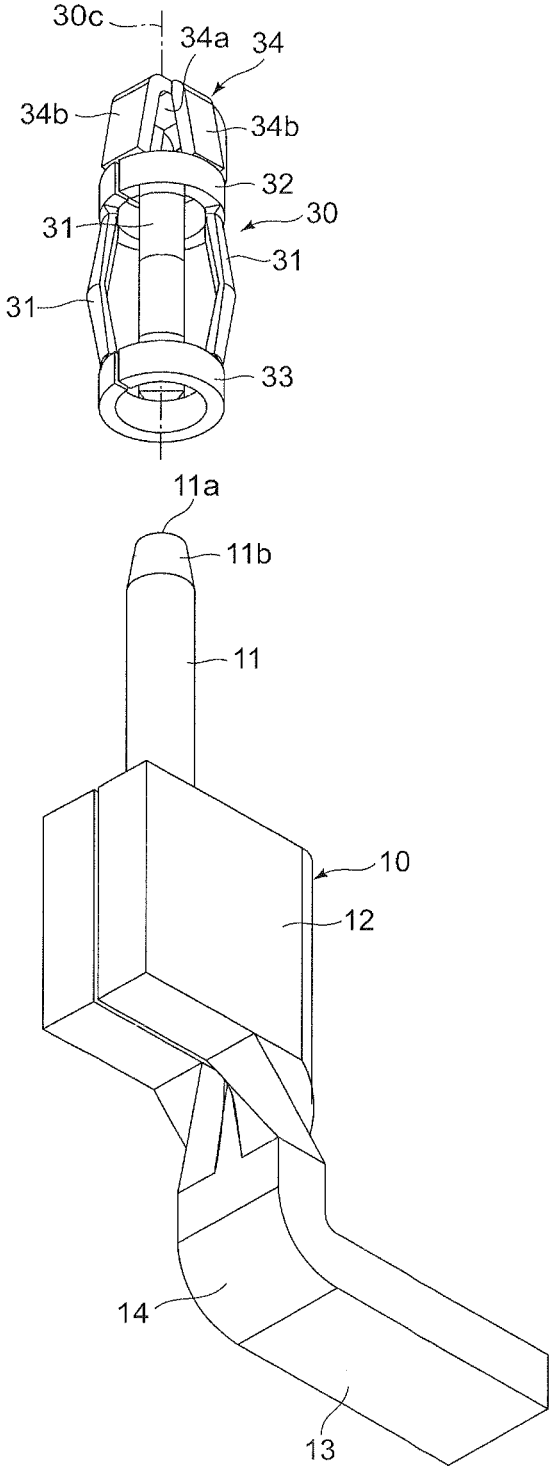
FIG. 8 is a broken perspective view of the press-fit connector terminal illustrated in FIG. 1.

The press-fit connector terminal 100 illustrated in FIGS. 1 and 2 is fabricated by inserting the terminal body 11 into the contact unit 30, as illustrated in FIGS. 7 and 8, and then, the cover 34 is welded at a lower surface of the flat portion 34*a* to the flat top surface 11*a* of the upper portion 11*b* of the terminal body 11 in an welding area W, as illustrated in FIG. 4. In the press-fit connector terminal 100, a center line 11*c* of the terminal body 11 and the imaginary center line 30*c* of the contact unit 30 are coincident with each other. As illustrated in FIGS. 3 and 4, an upper surface of the support portion 12 and a lower surface of the second binder 33 are spaced away from each other.

The terminal body 11 and the cover 34 may be joined to each other by caulking in place of the above-mentioned welding.

Figure 9:
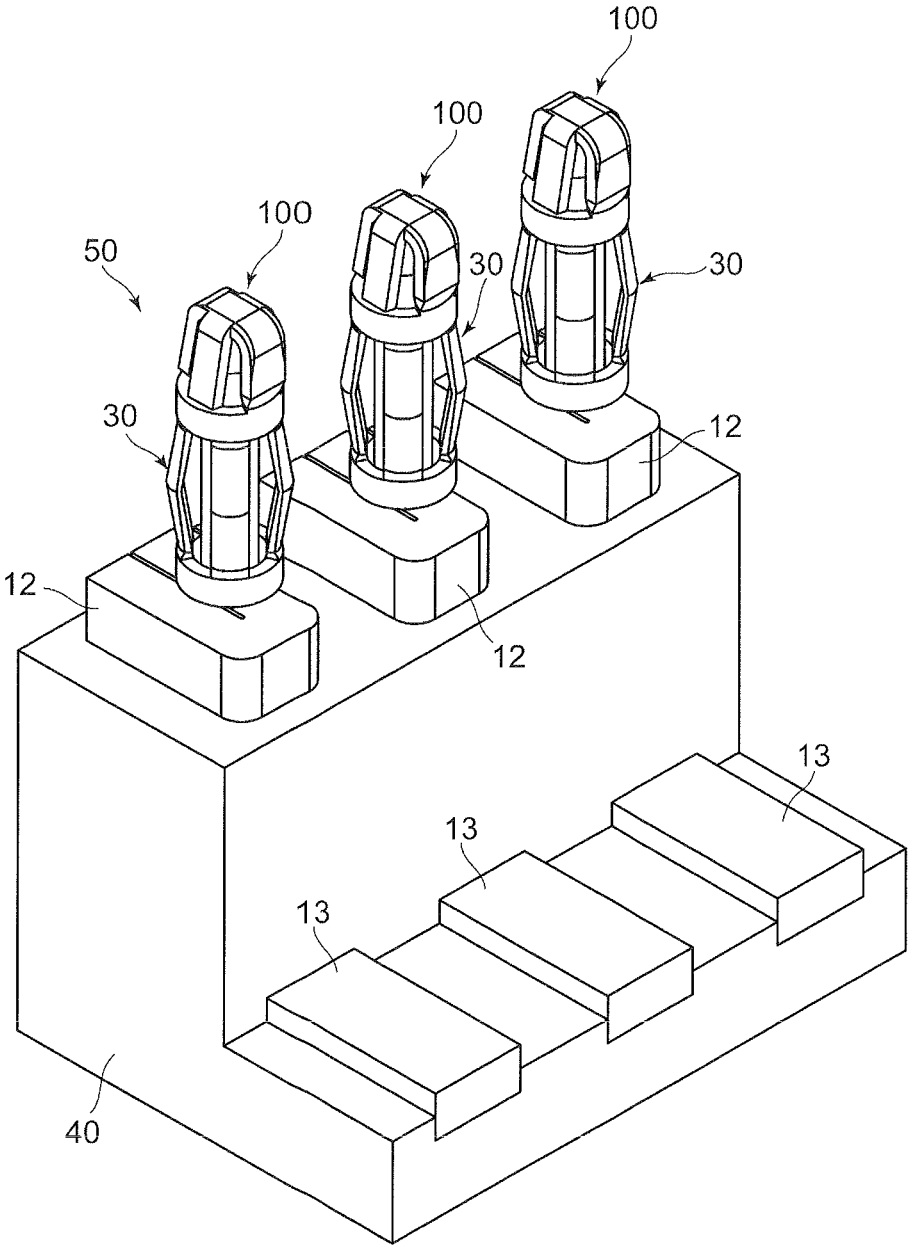
FIG. 9 is a perspective view of a terminal module including the press-fit connector terminal illustrated in FIG. 1.

As illustrated in FIG. 9, a terminal module 50 is completed by fixing the support portion 12 and the elbow portions 14 of a plurality of the press-fit connector terminals 100 into a constant posture by means of a base 40 made of an electrically insulative resin. The terminal module 50 is fabricated by forming the base 40 integrally with the press-fit connector terminals 100. As an alternative, the base 40 may be fabricated separately from the press-fit connector terminals 100.

Figure 10:
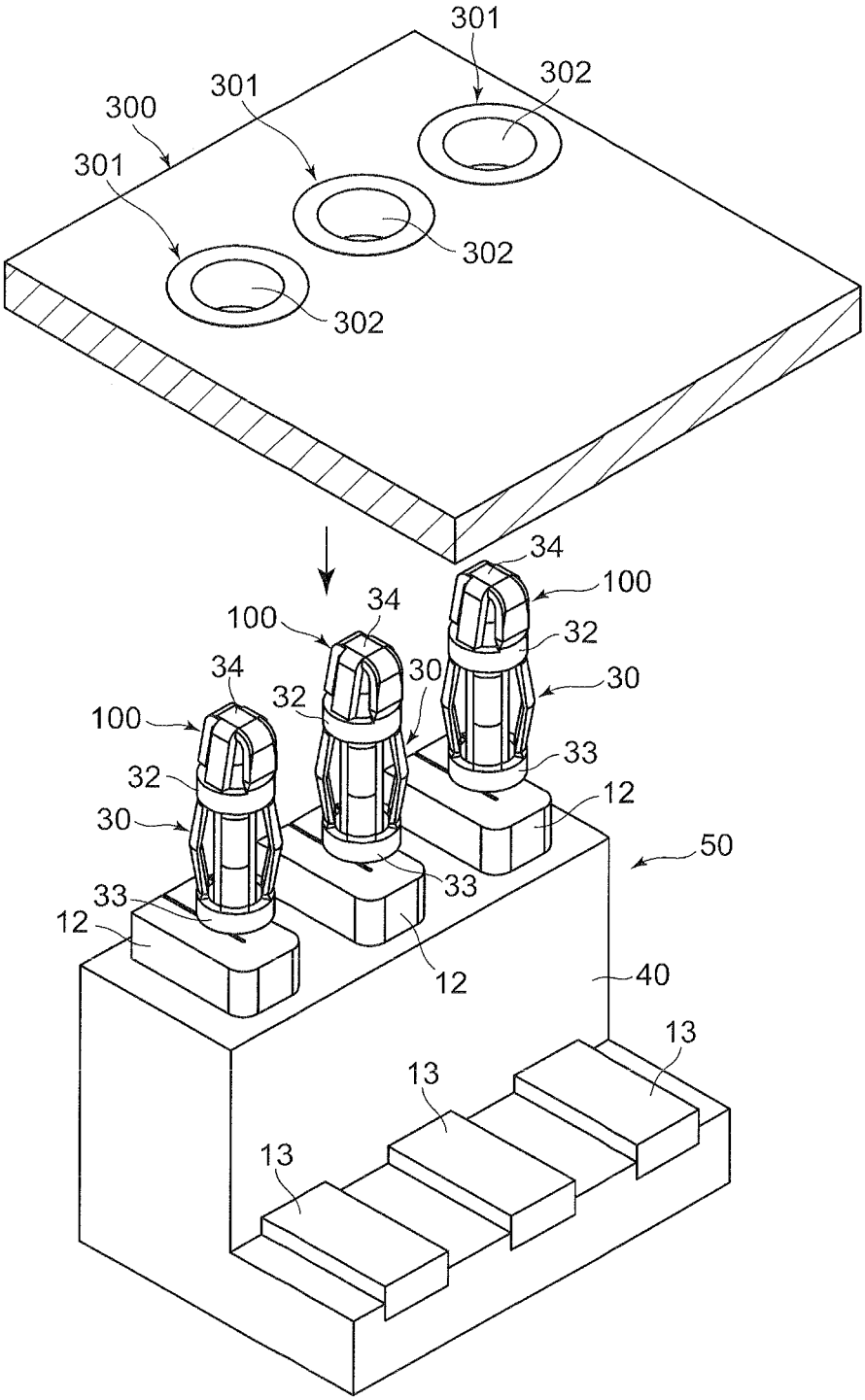
FIG. 10 is a perspective view showing a step of connecting the terminal module illustrated in FIG. 9 to a partially illustrated circuit substrate.
Figure 11:
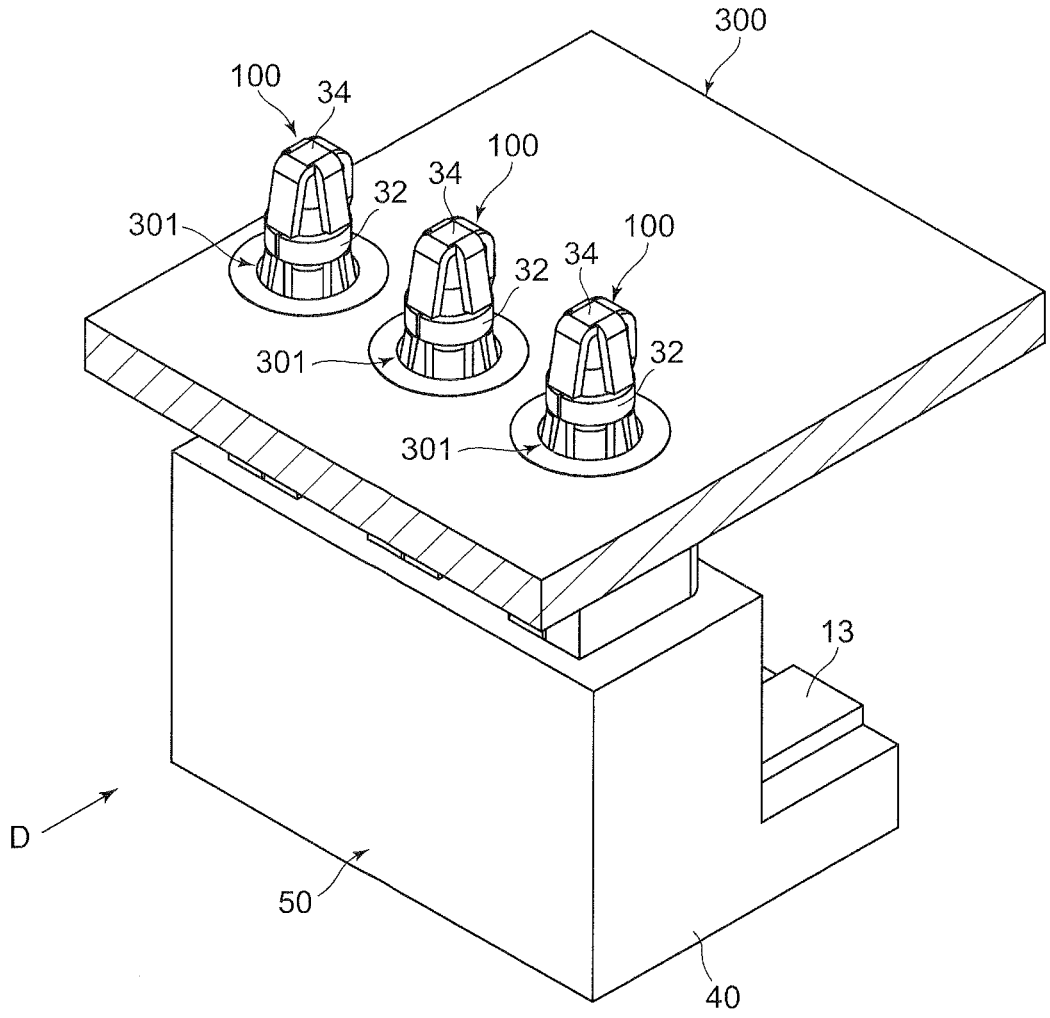
FIG. 11 is a perspective view illustrating the terminal module illustrated in FIG. 9 having been connected to a partially illustrated circuit substrate.
Figure 12:
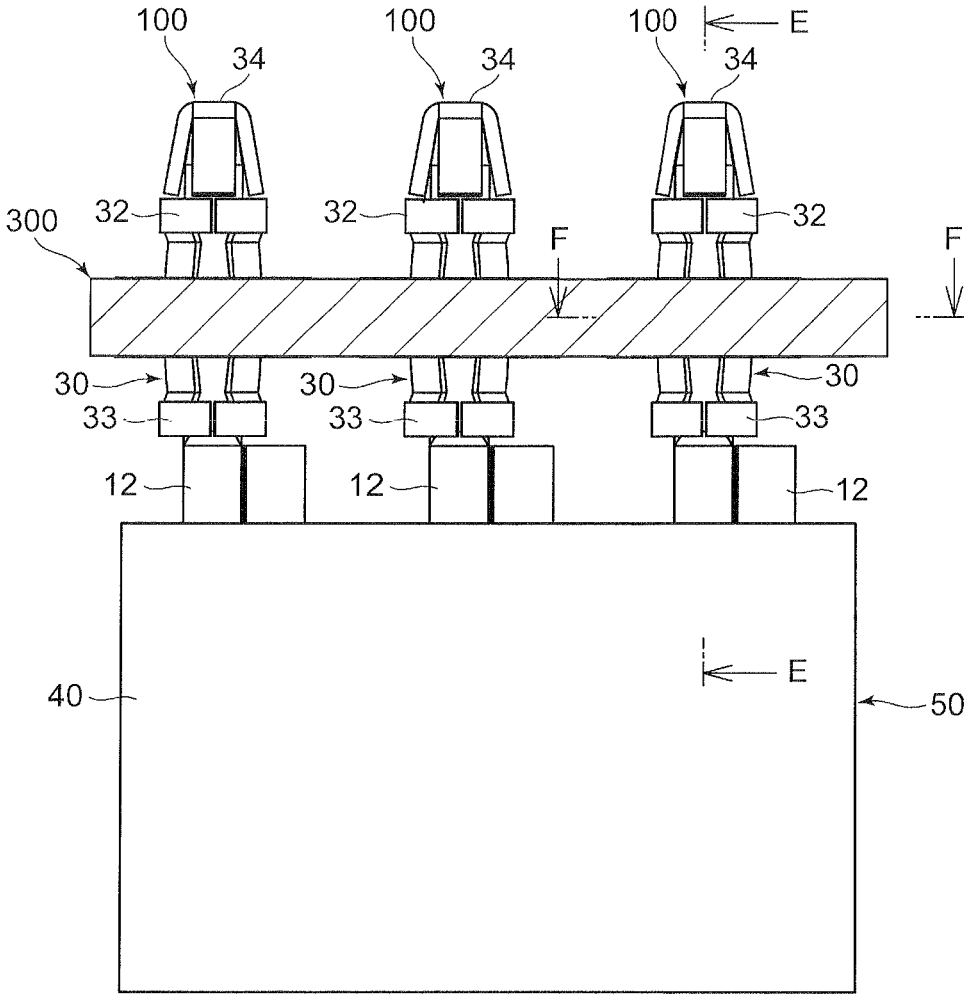
FIG. 12 is a view seen in a direction indicated with an arrow D shown in FIG. 11.
Figure 13:
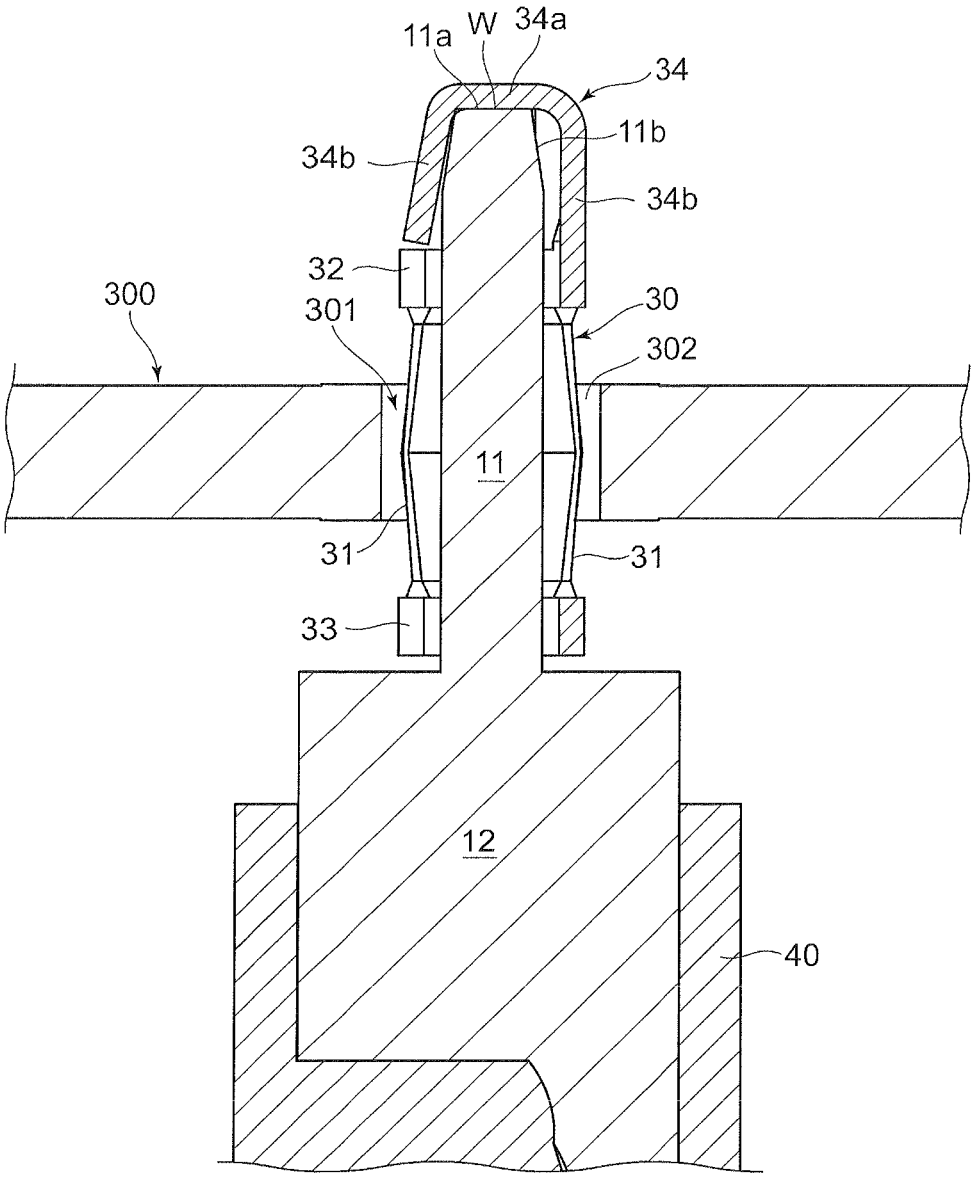
FIG. 13 is a partial cross-sectional view taken along the line E-E shown in FIG. 12.
Figure 14:
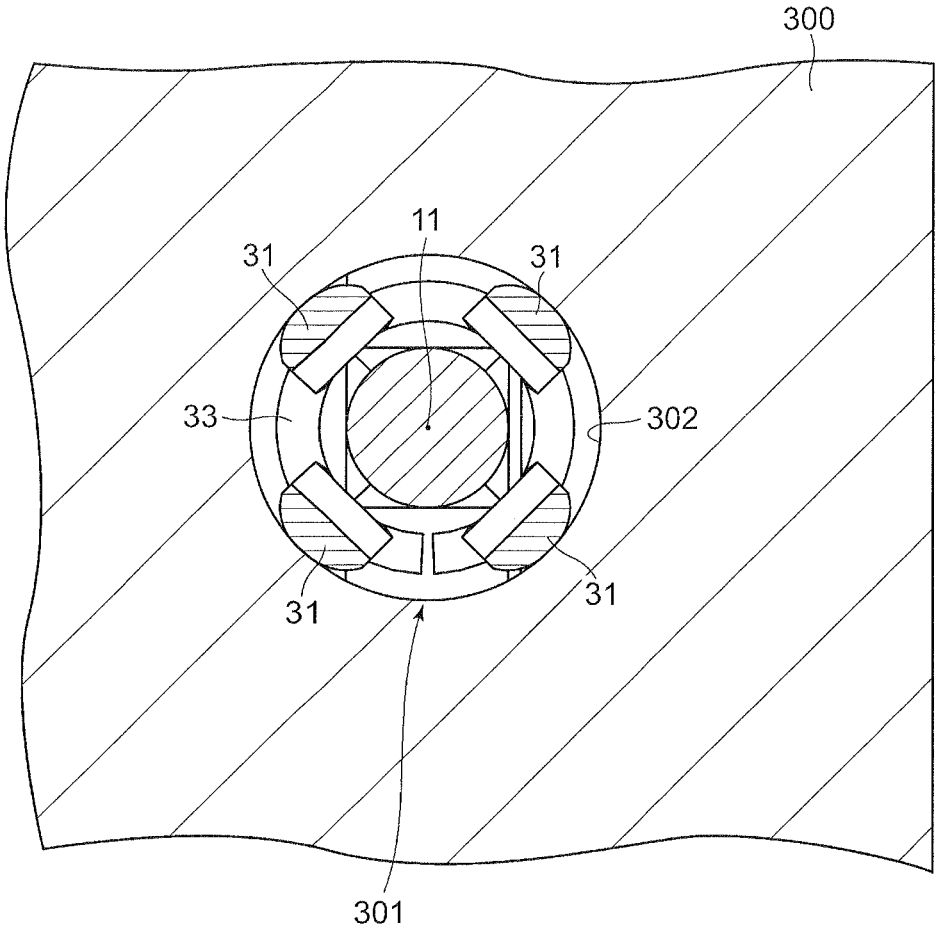
FIG. 14 is a partial cross-sectional view taken along the line F-F shown in FIG. 12.

In the press-fit connector terminals 100, since the pin section 10 and the terminal body 11 are made of a material having higher electrical conductivity than the same of the contact unit 30, the press-fit connector terminal 100 is able to allow a relatively large of amount of a current to run there-through. Furthermore, the contact unit 30 is made of an electrically conductive material acting as a spring to a greater degree than the pin section 10 and the terminal body 11. Specifically, the contact pieces 31 defining the contact unit 30 are designed to be elastically expandable and shrinkable relative to the terminal body 11 or the imaginary center line 30*c*, and accordingly, the contact unit 30 has a function as acting as a press-fit terminal, ensuring that when the press-fit connector terminal 100 is inserted into the through-hole 301 of the circuit substrate 300, as illustrated in FIG. 10, the press-fit connector terminal 100 does not damage the circuit substrate 300 and/or the inner surface 302 of the through-hole 301, and further ensuring stable connection between the press-fit connector terminal 100 and the through-hole 301.

Figure 15:
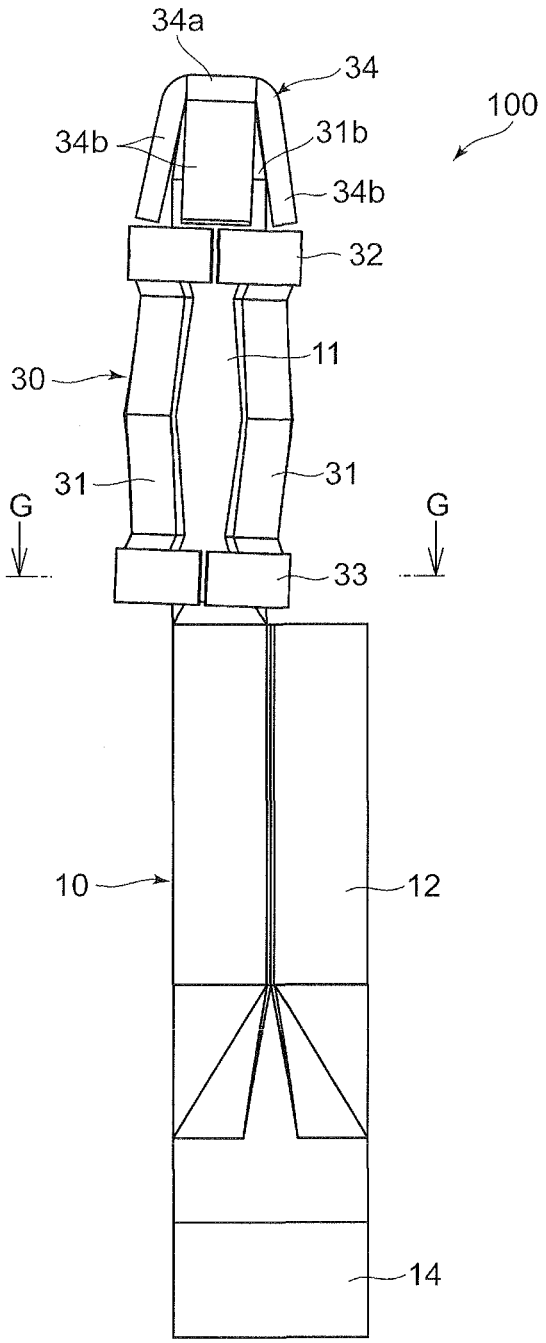
FIG. 15 illustrates the press-fit connector terminal illustrated in FIG. 1 being a condition of floating.
Figure 16:
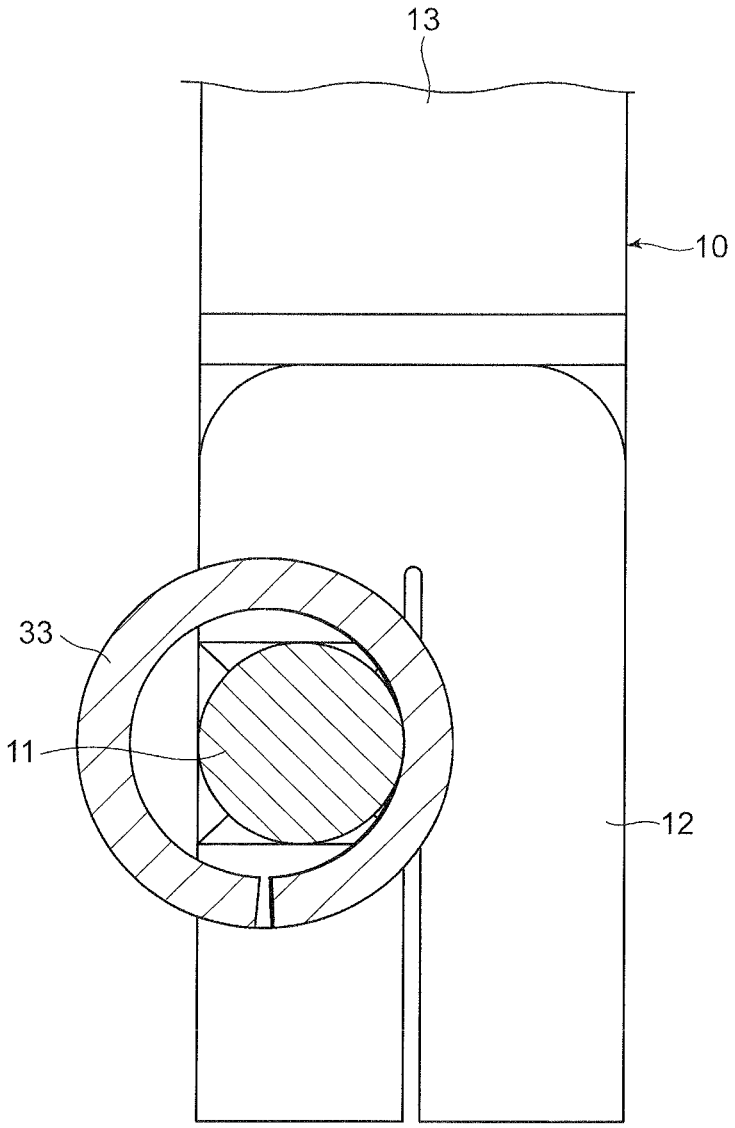
FIG. 16 is a cross-sectional view taken along the line G-G shown in FIG. 15.

As illustrated in FIGS. 11 to 14, the terminal body 11 and the contact pieces 31 of the contact unit 30 are designed to have such a size that when the press-fit connector terminal 100 is fit into the through-hole 301, between the terminal body 11 and the contact pieces 31 is generated a gap S sufficient for the contact pieces 31 to be able to come close to and go away from the terminal body 11, and the terminal body 11 and the contact unit 30 are joined to each other at the welded area W situated above the circuit substrate 300. That is, the cover 34 is joined to the upper portion 11*b* of the terminal body 11 passing through the through-hole 301 and protruding beyond the circuit substrate 300. Thus, as illustrated in FIGS. 15 and 16, the extensions 34*b* of the contact unit 30 are swingable relative to the terminal body 11 around the welded area W. Namely, the contact unit 30 defines an elastically deformable floating structure movable relative to the terminal body 11.

Accordingly, when the press-fit connector terminal 100 is inserted into the through-hole 301, even if the press-fit connector terminal 100 and the through-hole 301 of the circuit substrate 300 axially deviate from each other, the extensions 34*b* of the contact unit 30 swing around the welded area W relative to the terminal body 11 to thereby absorb the axial deviation of the press-fit connector terminal 100 from the through-hole 301, as illustrated in FIGS. 15 and 16. Thus, contact pressure between the contact pieces 31 of the contact unit 30 and the inner surface 302 of the through-hole 301 is uniformized, ensuring stable connection between the press-fit connector terminal 100 and the through-hole 301.

Second Embodiment

A press-fit connector terminal 200 according to the second embodiment of the present invention is explained hereinbelow with reference to FIGS. 17 to 21.

Parts or elements that correspond to those of the press-fit connector terminal 100 illustrated in FIGS. 1 to 16 have been provided with the same reference numerals, operate in the same manner as corresponding parts or elements in the press-fit connector terminal 100, unless explicitly explained hereinbelow, and are not explained.

Figure 17:
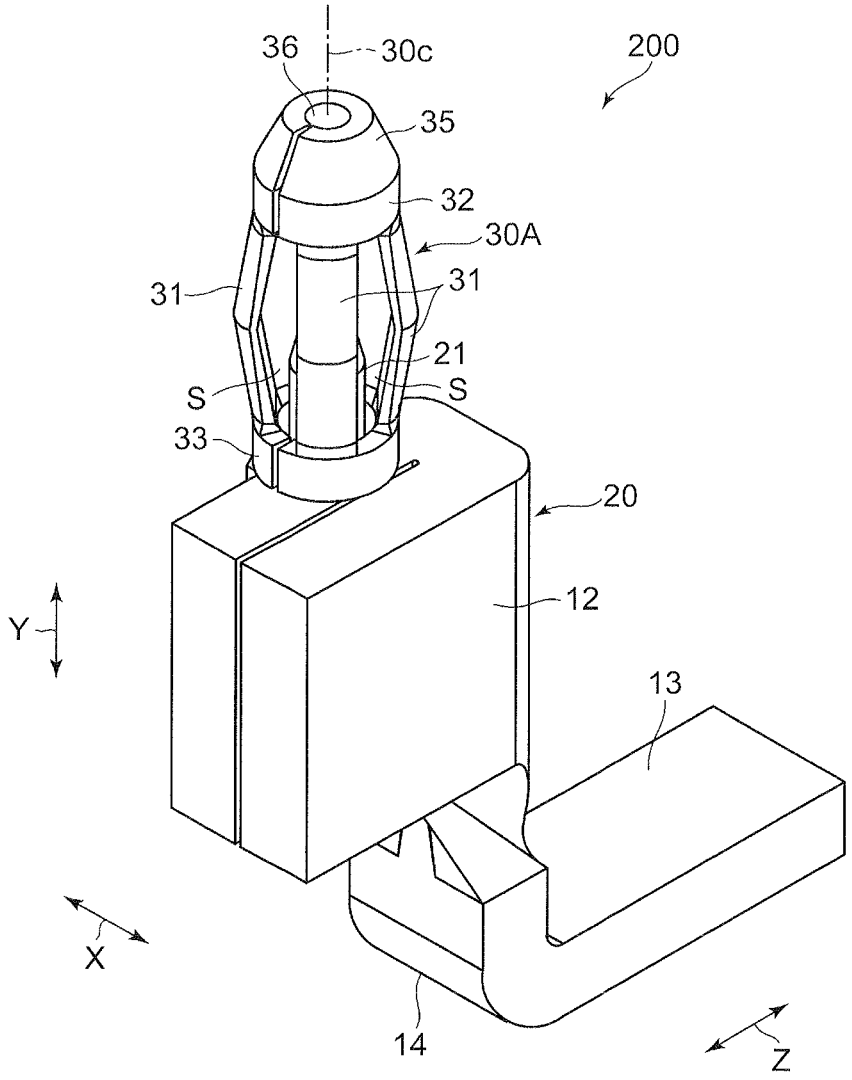
FIG. 17 is a perspective view of the press-fit connector terminal according to the second embodiment of the present invention.
Figure 18:
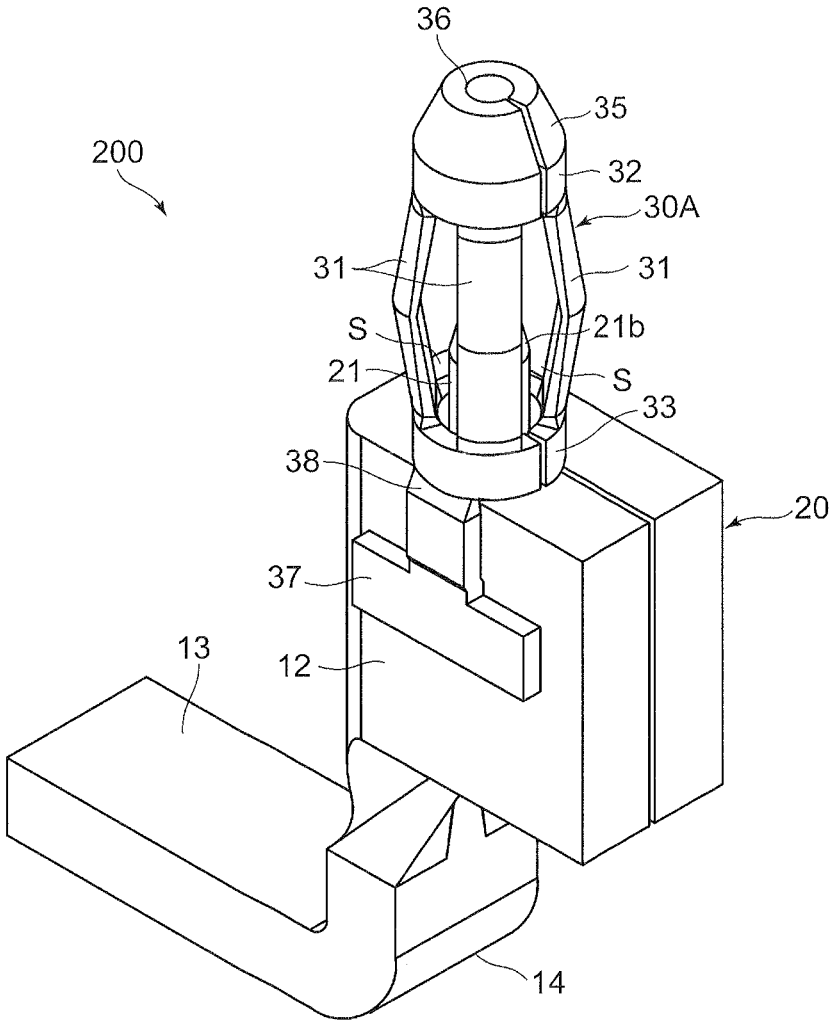
FIG. 18 is a perspective view of the press-fit connector terminal illustrated in FIG. 17.

As illustrated in FIGS. 17 and 18, the press-fit connector terminal 200 includes a cover 35 having a shaped of a truncated cone. The cover 35 is continuous to and located on the first binder 32. The cover 35 is formed at a top end thereof with a through-hole 36 extending in a direction of an imaginary center line 30*c*.

The press-fit connector terminal 200 further includes a T-shaped connecting portion 37 extending towards a pin section 20 from a part of the second binder 33, that is, extending in a direction opposite to a direction in which the contact pieces 31 extend from the second binder 33 towards the first binder 32.

Figure 19:
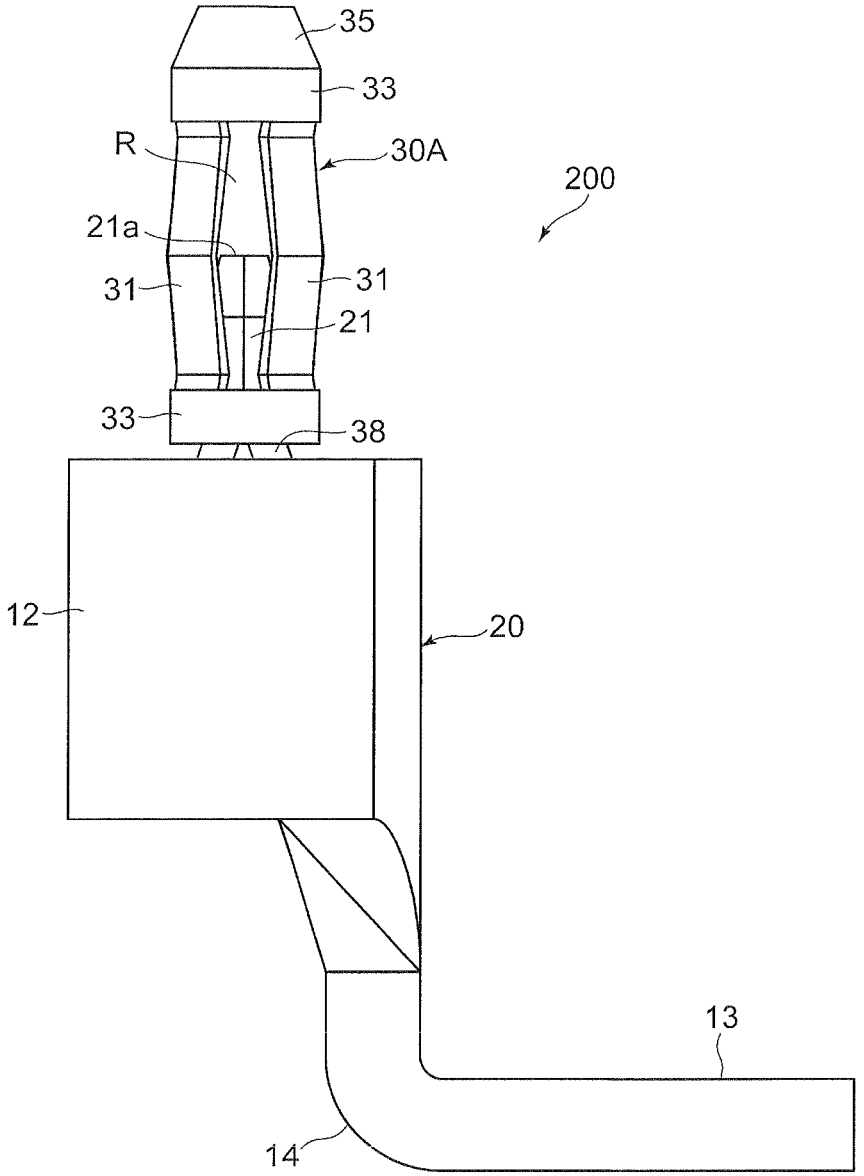
FIG. 19 is a right side view of the press-fit connector terminal illustrated in FIG. 17.
Figure 20:
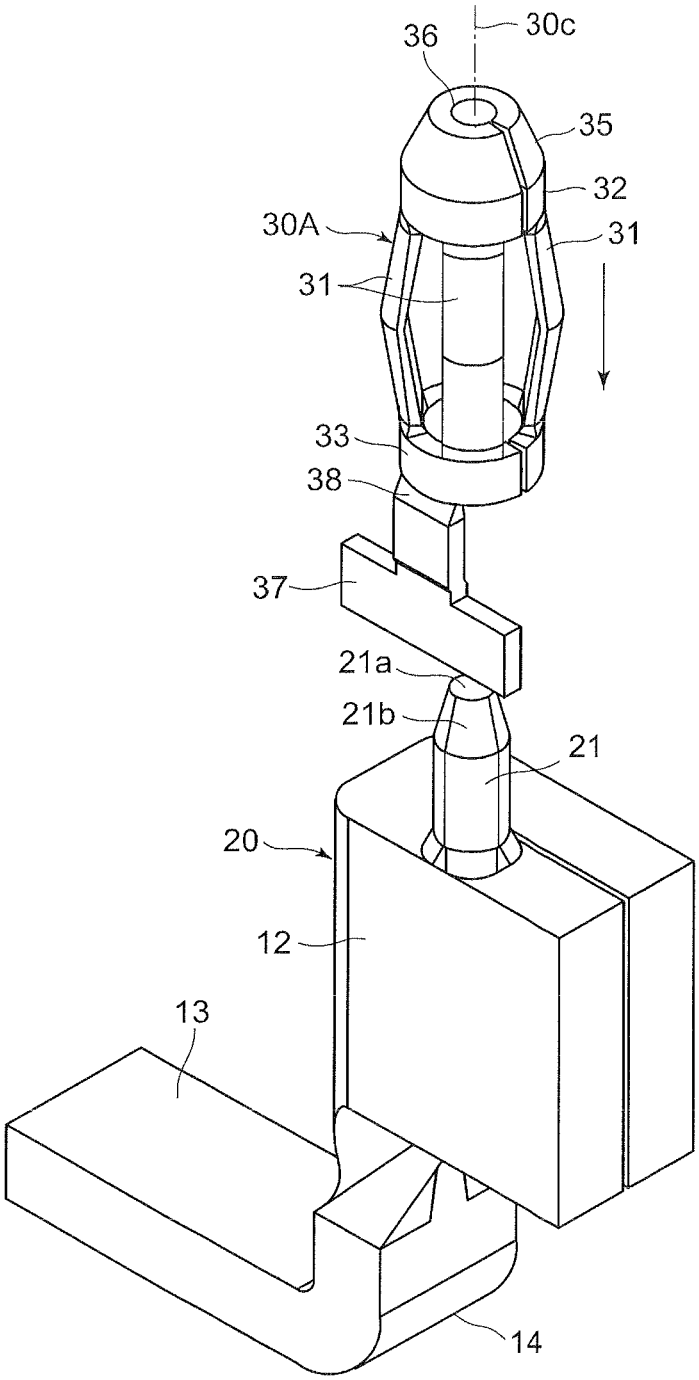
FIG. 20 is a broken perspective view of the press-fit connector terminal illustrated in FIG. 17.

As illustrated in FIGS. 19 and 20, a terminal body 21 stands on an upper surface of the support portion 12 of the pin section 20. The terminal body 21 includes a cylindrical portion and an upper portion 21*b* formed continuous to the cylindrical portion and having a shape of a truncated cone. The upper portion 21*b* has a flat top surface 21*a*.

The terminal body 21 is designed to have a length (a length between an upper surface of the support portion 12 and the flat top surface 21*a*) smaller than a length of a contact unit 30A in a direction of the imaginary center line 30*c* (or a distance between the first and second binders 32 and 33).

Figure 21:
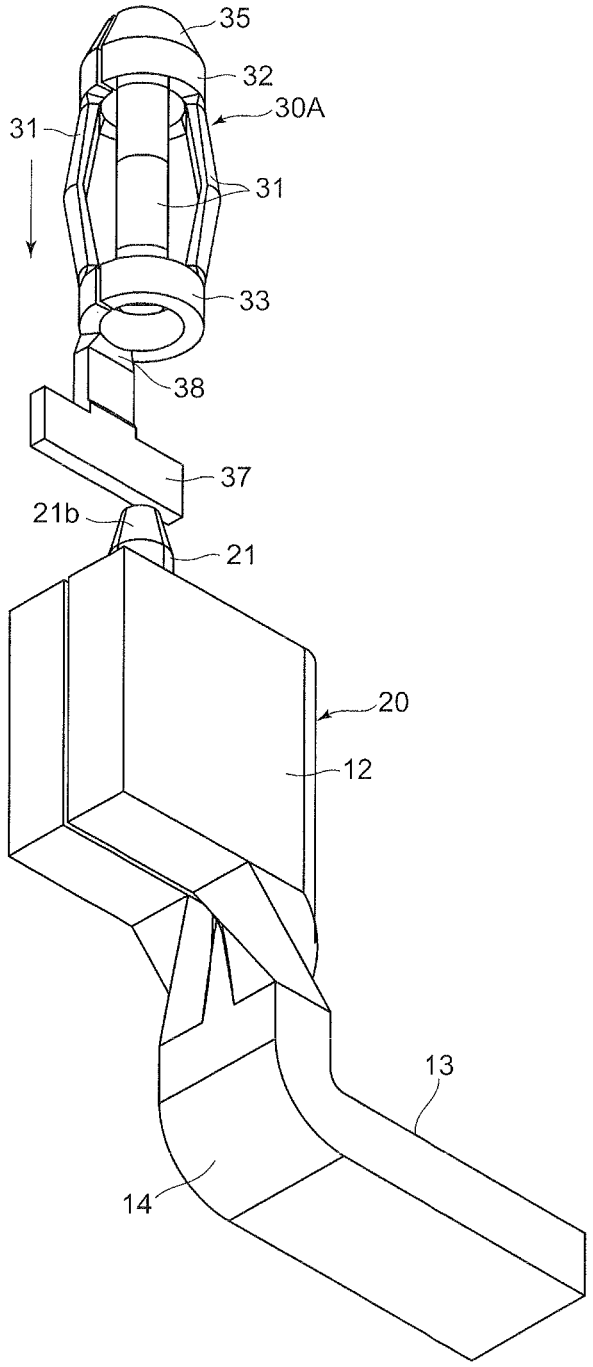
FIG. 21 is a broken perspective view of the press-fit connector terminal illustrated in FIG. 17.

As illustrated in FIGS. 20 and 21, the press-fit connector terminal 200 is completed by inserting the terminal body 21 of the pin section 20 into the contact unit 30A, and welding the connecting portion 37 onto a side of the support portion 12. As illustrated in FIG. 19, there is a gap between an upper surface of the support portion 12 and a lower surface of the second binder 33. The terminal body 21 and the cover 35 may be joined to each other by caulking in place of the above-mentioned welding.

As illustrated in FIGS. 17 to 19, there is formed the gap S in the contact unit 30A between the terminal body 21 and the contact pieces 31. After the press-fit connector terminal 200 has been inserted into the through-hole 301, the gap S is maintained to exist between the terminal body 21 and the contact pieces 31 such that the contact pieces 31 are able to be deformed towards and away from the terminal body 21.

As illustrated in FIG. 19, there is further formed a space R between the flat top surface 21*a* of the terminal body 2*i* and a lower surface of the cover 35. Similarly to the contact unit 30 illustrated in FIG. 1, the contact unit 30A has a press-fit function.

As illustrated in FIG. 18, the press-fit connector terminal 200 includes an elastically deformable boundary portion 38 formed between the second binder 33 and the connecting portion 38. As illustrated in FIG. 19, the boundary portion 38 is positioned on a level with the gap S.

Thus, the contact unit 30A can be elastically deformed around the boundary portion 38. In other words, the contact unit 30A is able to swing around the boundary portion 38 in a thickness-wise direction of the boundary portion 38. Thus, the contact unit 30A has a floating in structure, similarly to the contact unit 30 of the press-fit connector terminal 100 illustrated in FIG. 1.

It should be noted that the press-fit connector terminals 100 and 200 having been described with reference to FIGS. 1 to 21 are just examples of the present invention. It is to be understood that the subject matter encompassed by way of the present invention is not to be limited to the press-fit connector terminals 100 and 200 as specific embodiments. On the contrary, it is intended for the subject matter of the present invention to include all alternatives, modifications and equivalents as can be included within the spirit and scope of the following claims.

INDUSTRIAL APPLICABILITY

The press-fit connector terminal according to the present invention can be broadly employed in fields such as an electric/electronic industry and an automobile industry, as a connector to be inserted into a through-hole of a circuit substrate through which a large amount of current runs.

The entire disclosure of Japanese Patent Application No. 2014-245219 filed on Dec. 3, 2014 including specification, claims, drawings and summary is incorporated herein by reference in its entirety.

What is claimed is:

1. A press-fit connector terminal, comprising:

a terminal body having a length sufficient to pass through an electrically conductive through-hole formed through a circuit substrate; and a contact unit arranged around the terminal body so as to surround therewith about a central axis of the terminal body, the contact unit being formed capable of expanding/contracting in a radial direction around the central axis, wherein:

the contact unit has rigidity lower than that of the terminal body;

the terminal body is made of material with electrical conductivity greater than that of the contact unit; and when the terminal body and the contact unit are integrally inserted into the through-hole, a gap exists between the terminal body and the contact unit so that the contact unit is movable relative to the terminal body in the radial direction within the through-hole.

2. The press-fit connector terminal as defined in claim 1, wherein the contact unit includes a plurality of contact pieces arranged around the terminal body to outwardly protrude.

3. The press-fit connector terminal as defined in claim 2, further comprising first and second binders surrounding the terminal body at distal and proximal ends of the contact unit, wherein:

each of the first and second binders has a C-shaped cross-section; and the contact pieces are connected to the first and second binders.

4. The press-fit connector terminal as defined in claim 3, further comprising a cover situated adjacent to the first binder, wherein the cover covers a distal end of the terminal body.

5. The press-fit connector terminal as defined in claim 4, wherein the cover includes:

a flat portion; and a plurality of extensions extending in a common direction from an outer periphery of the flat portion;

one of the extensions is connected to the contact unit through the first binder; and the terminal body is bonded at a top surface thereof with a lower surface of the flat portion such that the contact unit is swingable relative to the terminal body around the top surface of the terminal body.

6. The press-fit connector terminal as defined in claim 3, further comprising:

a support portion made of an electrically conductive material; and a connecting portion, wherein:

the terminal body stands on an upper surface of the support portion;

the connecting portion extends towards the support portion from the second binder; and the connecting portion is bonded to a side of the support portion such that there is a gap generated between the second binder and an upper surface of the support portion.

7. The press-fit connector terminal as defined in claim 6, wherein:

an elastically deformable boundary portion is formed between the second binder and the connecting portion; and the boundary portion is positioned on a level with the gap.

8. The press-fit connector terminal as defined in claim 6, wherein the support portion is constituted of two electrically conductive sheets bonded to each other at an end thereof and overlapping one on another.

9. The press-fit connector terminal as defined in claim 6, wherein the terminal body and the support portion are made of a material having electrical conductivity of at least 99.9% IACS.

10. A press-fit connector terminal, comprising:

a terminal body having a length sufficient to pass through an electrically conductive through-hole formed through a circuit substrate; and a contact unit arranged around the terminal body so as to surround therewith about a central axis of the terminal body, the contact unit being formed capable of expanding/contracting in a radial direction around the central axis, wherein:

the contact unit has rigidity lower than that of the terminal body;

the terminal body is made of material with electrical conductivity greater than that of the contact unit; and when the terminal body and the contact unit are integrally inserted into the through-hole, a gap exists between the terminal body and the contact unit so that the contact unit is movable relative to the tell final body in the radial direction within the through-hole, wherein the contact unit includes a plurality of contact pieces arranged around the terminal body to outwardly protrude, said press-fit connector terminal further comprising first and second binders surrounding the terminal body at distal and proximal ends of the contact unit, wherein:

each of the first and second binders has a C-shaped cross-section; and the contact pieces are connected to the first and second binders, a cover situated adjacent to the first binder, and wherein the cover covers a distal end of the terminal body, wherein the cover includes:

a flat portion; and a plurality of extensions extending in a common direction from an outer periphery of the flat portion;

one of the extensions is connected to the contact unit through the first binder; and the terminal body is bonded at a top surface thereof with a lower surface of the flat portion such that the contact unit is swingable relative to the terminal body around the top surface of the terminal body.

11. A press-fit connector terminal, comprising:

a terminal body having a length sufficient to pass through an electrically conductive through-hole formed through a circuit substrate; and a contact unit arranged around the terminal body so as to surround therewith about a central axis of the terminal body, the contact unit being formed capable of expanding/contracting in a radial direction around the central axis, wherein:

the contact unit has rigidity lower than that of the terminal body;

the terminal body is made of material with electrical conductivity greater than that of the contact unit; and when the terminal body and the contact unit are integrally inserted into the through-hole, a gap exists between the terminal body and the contact unit so that the contact unit is movable relative to the terminal body in the radial direction within the through-hole, wherein the contact unit includes a plurality of contact pieces arranged around the terminal body to outwardly protrude, said press-fit connector terminal further comprising first and second binders surrounding the terminal body at distal and proximal ends of the contact unit, wherein:

each of the first and second binders has a C-shaped cross-section; and the contact pieces are connected to the first and second binders, and a support portion made of an electrically conductive material; and a connecting portion, wherein:

the terminal body stands on an upper surface of the support portion;

the connecting portion extends towards the support portion from the second binder; and the connecting portion is bonded to a side of the support portion such that there is a gap generated between the second binder and an upper surface of the support portion.

12. The press-fit connector terminal as defined in claim 11, wherein:

an elastically deformable boundary portion is formed between the second hinder and the connecting portion; and the boundary portion is positioned on a level with the gap.

13. The press-fit connector terminal as defined in claim 11, wherein the support portion is constituted of two electrically conductive sheets bonded to each other at an end thereof and overlapping one on another.

14. The press-fit connector terminal as defined in claim 11, wherein the terminal body and the support portion are made of a material having electrical conductivity of at least 99.9% IACS.

* * * * *